US008561332B2

(12) United States Patent
Garfinkle

(10) Patent No.: US 8,561,332 B2
(45) Date of Patent: Oct. 22, 2013

(54) MULTI-WAY SIGNAGE

(76) Inventor: Benjamin L. Garfinkle, Piedmont, CA (US)

( * ) Notice: Subject to any disclaimer, the term of this patent is extended or adjusted under 35 U.S.C. 154(b) by 0 days.

(21) Appl. No.: 13/536,934

(22) Filed: Jun. 28, 2012

(65) Prior Publication Data

US 2012/0266509 A1 Oct. 25, 2012

Related U.S. Application Data

(63) Continuation-in-part of application No. 11/936,942, filed on Nov. 8, 2007, which is a continuation-in-part of application No. 11/412,514, filed on Apr. 27, 2006.

(51) Int. Cl.
*G09F 3/18* (2006.01)

(52) U.S. Cl.
USPC ..... 40/649; 40/618

(58) Field of Classification Search
USPC ..... 40/5, 618, 649, 606.18
See application file for complete search history.

(56) References Cited

U.S. PATENT DOCUMENTS

| | | | | | |
|---|---|---|---|---|---|
| 162,992 | A * | 5/1875 | Amsden et al. | 40/5 |
| 445,838 | A * | 2/1891 | Larkin | 40/618 |
| 448,290 | A * | 3/1891 | Zallud | 40/5 |
| 737,888 | A * | 9/1903 | Webber | 40/649 |
| 1,564,595 | A * | 12/1925 | Lohrer | 40/5 |
| 1,610,525 | A * | 12/1926 | Hoge | 40/384 |
| 1,714,824 | A * | 5/1929 | Staples | 229/71 |
| 1,822,492 | A * | 9/1931 | Lamb | 40/611.05 |
| 2,033,998 | A * | 3/1936 | Prager | 206/103 |
| 5,967,343 | A * | 10/1999 | Dufresne | 211/86.01 |
| 2007/0266604 | A1 * | 11/2007 | Garfinkle | 40/649 |

* cited by examiner

*Primary Examiner* — Gary Hoge
(74) *Attorney, Agent, or Firm* — Bay Area Technology Law Group PC

(57) ABSTRACT

A sign system for displaying product information to consumers positioned proximate a product being vended. The sign system is characterized as having a planar support and a primary sign is releasably retained by the planar support having product information made visible to the consumers and further having a window configured therein. A secondary sign is releasably retained behind the primary sign such that at least a portion of the secondary sign is visible through the window, the secondary sign having a plurality of alternative pricing indicia strategically positioned thereon such that through repositioning the secondary sign behind the primary sign, alternative pricing indicia is displayed through said window. An organizer is also employed for storing secondary pricing signs for easy access.

6 Claims, 4 Drawing Sheets

MULTI-WAY SIGNAGE

RELATED APPLICATIONS

The present application is a continuation in part of U.S. application Ser. No. 11/936,942 filed on Nov. 8, 2007 which is in turn a continuation in part of U.S. application Ser. No. 11/412,514 filed on Apr. 27, 2006.

TECHNICAL FIELD

A sign system for displaying product information to consumers and positioned proximate a product being vended. The sign system is characterized as having a substantially planar support positioned to face consumers and having a primary sign releasably retained by it. The primary sign provides information related to the product being vended and has a window configured therein. A secondary sign is releasably retained behind the primary sign such that at least a portion of the secondary sign is visible through the window, the secondary having a plurality of alternative pricing indicia strategically positioned thereon such that through repositioning the secondary sign behind the primary sign, alternative pricing indicia is displayed to consumers.

BACKGROUND OF THE INVENTION

Retail establishments such as food markets vend upwards of thousands of items on shelves and in display cases. Retail establishments carrying such products must be able to display signage in conjunction therewith which is not only attractive but informative to consumers.

Various departments within retail food markets repeatedly carry the same or similar items. For example, a seafood department would routinely carry farmed or wild salmon meaning that signage which informs the consumer that such products are available for sale can be reused multiple times. However, the price of such products can vary significantly and, as a consequence, the need presents itself to enable the merchant to repeatedly use informative signage where pricing can be varied as needed.

In addition to the above, most retail food markets employ computerized tracking systems to enable merchants to determine which products are successfully being purchased and which remain on store shelves. This information is critical to enable a vendor to maximize profitability by eliminating from store shelves those products which are not being purchased while enabling the vendor to effectively reorder those products which its data system indicates are successful and thus being depleted in inventory. As such, in addition to employing primary signs to inform a customer of the nature of the products being sold and a secondary sign for providing pricing information, the secondary sign can also contain a good deal of information which is necessary for product tracking through computerized databases but which would detract from the visually appealing impact which product signage should otherwise create. Providing such primary signage was the subject of applicant's parent applications identified above.

Applicant's parent applications focused on the use of secondary signage which displays the price of the product being vended together with additional information which would be obscured by appropriate sizing of a window configured within the primary sign. As such, when pricing changed, the secondary sign located behind the primary sign would be withdrawn and either discarded or saved for possible future use to be replaced by another secondary sign containing the appropriate product pricing information.

It has been realized by applicant that many products sold in retail food markets although differing in price from time to time, quite often are priced somewhat consistently. For example, once a food product is introduced to consumers, the price point would be established. That price point may drop to meet competitor's prices or if the product is perishable and begins approaching its maximum shelf life to encourage its purchase. These pricing patterns, again, tend to follow a somewhat repeatable cycle so that the retail food establishment could oftentimes predict price points for specific products being sold.

Even when there is a degree of predictability in product pricing, many products go through cycles which require pricing variations. This may result in having to inventory perhaps four or more different secondary pricing signages which a store clerk would access for different products and during the life cycle of a single product. In order to reduce costs and provide for a simpler routine for displaying price changes and adjustments, the present invention proposes a secondary sign providing for pricing flexibility unavailable from signage products of the prior art.

These and further objects will be readily apparent when considering the following disclosure and appended claims.

SUMMARY OF THE INVENTION

A sign system for displaying product information to consumers positioned proximate a product being vended. The sign system is characterized as having a planar support positioned to face consumers. A primary sign is releasably retained by the planar support having product information made visible to the consumers and further having a window configured therein. A secondary sign is releasably retained behind the primary sign such that at least a portion of the secondary sign is visible through the window, the secondary sign having a plurality of alternative pricing indicia strategically positioned thereon such that through repositioning the secondary sign behind the primary sign, alternative pricing indicia is displayed through said window. An organizer is also employed for storing secondary pricing signs for easy access.

DETAILED DESCRIPTION OF THE INVENTION

Figure 1A:
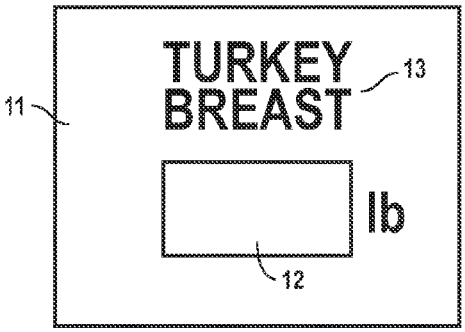
FIGS. 1A through 1F are plan views of a first embodiment of the signage of the present invention.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

The present invention is directed to a sign system for displaying product information to consumers to be positioned proximate a product being vended to them. Applicant incorporates by reference examples of suitable sign systems as, for example, FIGS. 4-14 of parent U.S. application Ser. No. 11/936,942. The material incorporated by reference shows various alternatives employed for maintaining the sign system of the present invention in a predetermined orientation. Planar supports are employed, the usage of which would be quite apparent to anyone skilled in the signage field. Examples of suitable planar supports are shown herein in FIGS. 3A and 3B as elements 31 and 32 supporting the signage of the present invention.

Figure 3A:
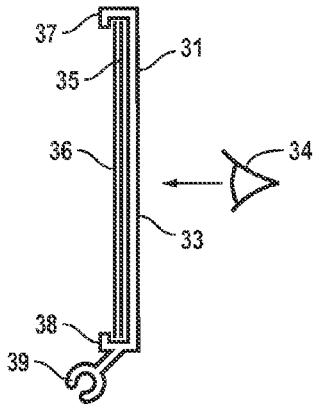
FIGS. 3A and 3B are side views of examples of signage assembly options as holders for the signage of FIG. 1 and FIG. 2.

Turning first to FIG. 3A, substantially planar support 31 is shown having transparent face 33 facing consumer 34. Primary sign 35 would lie flush against transparent planar face 33 and behind it would be secondary sign 36 noting that both signs 35 and 36 would be held in registry against transparent planar face 33 by U-shaped ends 37 and 38. The entire assembly could be appended to a suitable base or other fixtures (not shown) by connector 39.

Figure 3B:
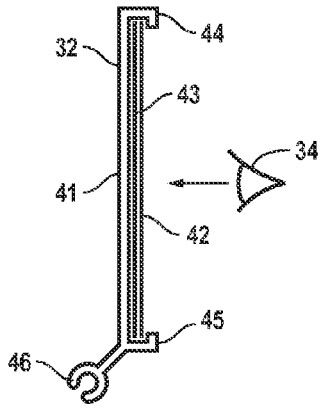
Figure 4A:
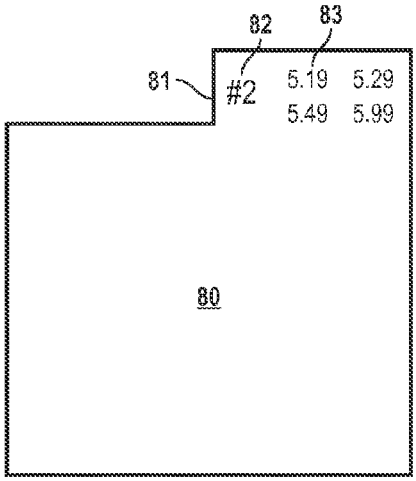
FIGS. 4A and 4B are plan views of dividers useful in creating a price point organizer made part of the sign system of the present invention.
Figure 4B:
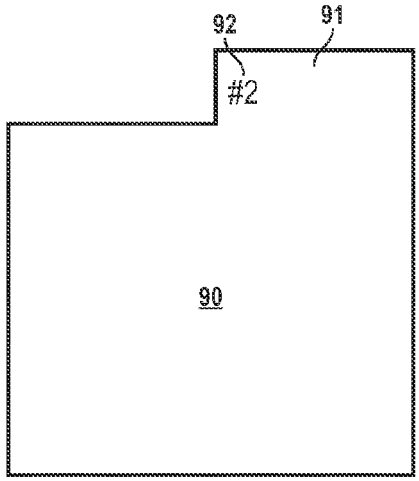
Figure 5:
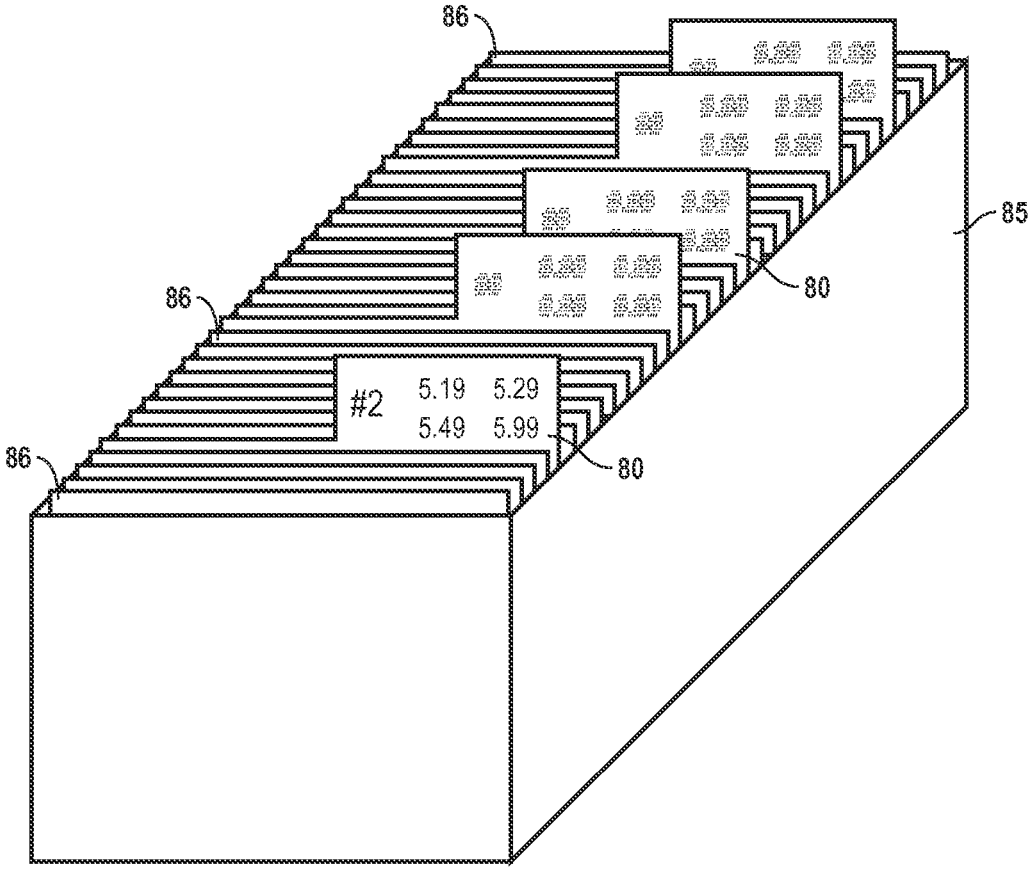
FIG. 5 is a perspective view of an organizer for signage of the present invention and employing the dividers of FIGS. 4A and 4B.

The sign system of FIG. 3B is similar to that shown in FIG. 3A however, in this instance, planar transparent support 41 is intended to face a store clerk and not consumer 34. Primary signage 42 is separated from transparent planar support 41 by secondary sign 43. As such, in each instance, primary sign 35/42 faces consumer 34 and secondary sign 36/43 is separated from consumer 34 by the primary sign. As in FIG. 3A, primary and secondary signs 42 and 43 are maintained in place by U-shaped ends 44 and 45 with connector 46 appending planar support 32 to a suitable base or fixture (not shown).

The present invention differs markedly from that of the parent applications by the creative and innovative signs depicted in FIGS. 1 and 2.

Figure 1B:
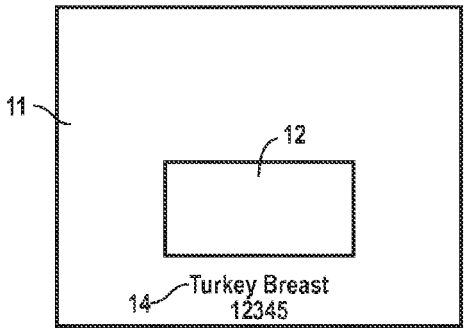

Turning to FIG. 1, it is noted that FIGS. 1A and 1B depict primary sign 11 the face intended for consumers shown in FIG. 1A with its back side intended to face store personnel shown in FIG. 1B. As illustrative, consumers would see that turkey breast is the product being sold in field 13 while the same information is made available to store personnel in field 14 the later to prevent employees from having to reach around to see what is displayed on the front (FIG. 1A) face of the sign. Further, field 14 can contain additional information of interest only to the store and not to consumers. In addition, primary sign 11 is configured with window 12, the utility of which will become quite apparent from the discussion below.

Figure 1C:
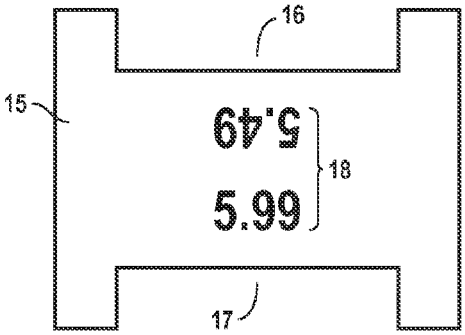
Figure 1D:
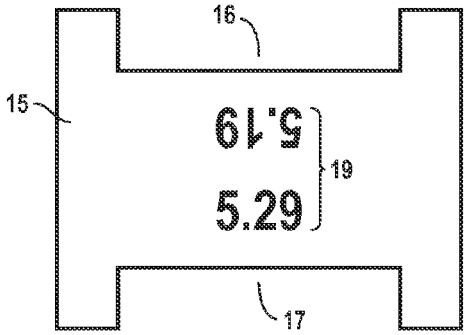
Figure 1E:
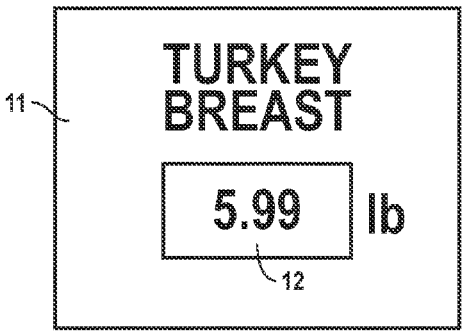
Figure 1F:
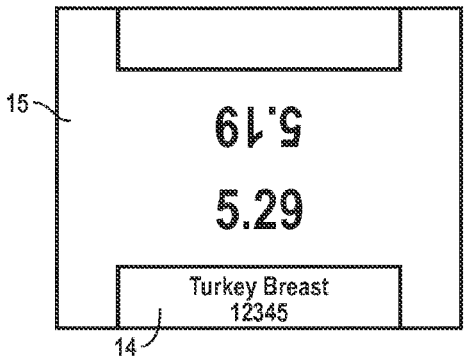
Figure 1G:
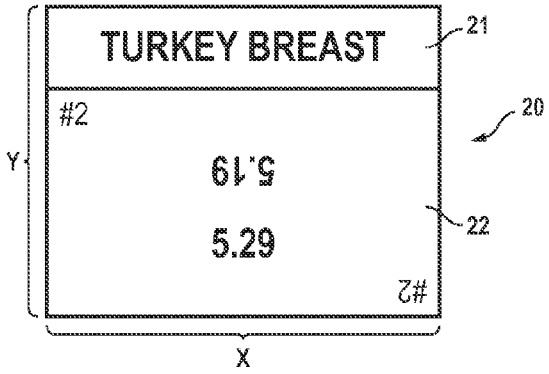
FIG. 1G is a plan view of a second embodiment of the signage of the present invention.

As a first embodiment of a secondary sign for use in connection with primary sign 11, reference is made to FIGS. 1C and 1D. It should first be noted that secondary sign 15, one side of which being the subject of FIG. 1C and the reverse side being the subject of FIG. 1D, is ideally sized to be approximately that of primary sign 11. This assists in the registration of secondary sign 15 behind primary sign 11 to ensure that the appropriate pricing information appears through window 12. As a preferred embodiment, the width of the primary and secondary signs should be approximately the same as typical holders for such signs do not facilitate keeping them aligned side to side. However, the height of the primary and secondary signs can differ, and in doing so, certain advantages could be achieved. More specifically, reference is made to FIG. 1G showing composite sign 20 including primary sign 21 and secondary sign 22. It should be noted that the signs are of the same approximate width X while, in the Y direction, primary sign 21 is longer than secondary sign 22. Sign holders can be made to frictionally keep primary and secondary signs 21 and 22 in register to ensure that price $5.29 per pound shows through the appropriate window in primary sign 21. A further advantage of the embodiment of FIG. 1G is that counter staff can read the turkey breast product information as shown even when the secondary sign is in place.

It should be readily apparent that depending upon whether the side of FIG. 1C or the side of FIG. 1D is placed immediately behind and in contact with the back of primary sign 11 (FIG. 1B), either the price $5.99 or price $5.29 would appear through window 12. However, by rotating secondary sign 15 180 degrees, the price $5.49 or the price $5.19 would appear through window 12. As such, by only configuring a singular secondary sign 15, four different price points can be established for the sale of turkey breast in conjunction with primary sign 11, the later not having to be at all altered when changing the price of a product displayed for sale.

It is further noted that secondary sign 15 can be provided with cut out portions 16 and 17. The reason for this becomes apparent when viewing FIG. 1F. Specifically, when secondary sign 15 is placed behind primary sign 11 such that the price, in this illustration, $5.99 per pound is made visible through window 12 (FIG. 1E), information provided to the store clerk on the back side of primary sign 11 is not obscured by joining secondary sign 15 to primary sign 11. Thus, secondary product information 14 related to primary product information 13 provided on the back side of primary sign 11 is made visible to store personnel by openings or cut our regions 16 and 17 as shown.

FIGS. 2A through 2D illustrate an alternative embodiment to that shown in FIG. 1 although numerous other embodiments can be employed, all of which would be quite apparent to one skilled in this art without departing from the spirit and scope of the present invention.

Figure 2A:
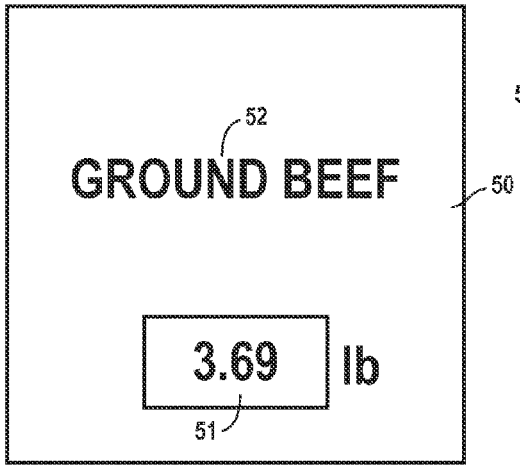
FIGS. 2A through 2D are plan views of a third embodiment of the signage of the present invention.
Figure 2B:
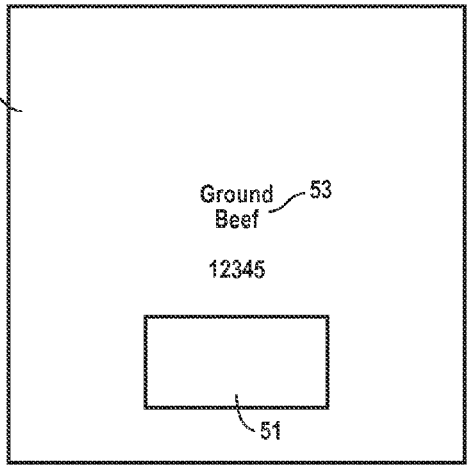

Turning back to FIG. 2, specific reference is made to FIGS. 2A and 2B illustrating the front and back sides of primary sign 50. In this instance, the consumer would see the front face (FIG. 2A) of primary sign 50 indicating that ground beef was for sale in field 52 thereof. The same information would be made available to the store clerk on the back side of primary sign 50 (FIG. 2B) and may include optional additional indicia in field 53. Window 51 would be configured within primary sign 50 similarly to the configuration discussed with regard to FIG. 1.

Figure 2C:
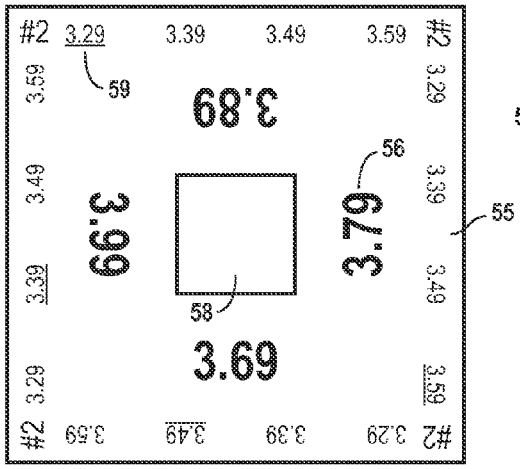
Figure 2D:
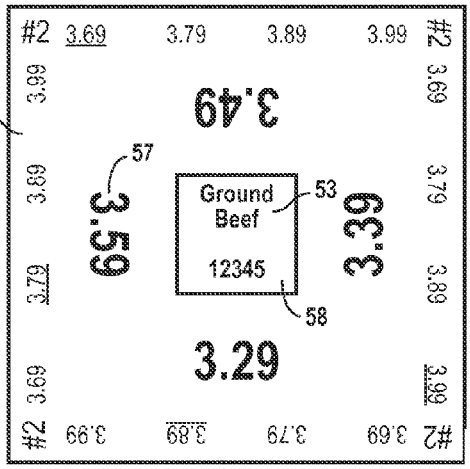

In continued reference to the second embodiment, secondary sign 55 is illustrated in FIGS. 2C and 2D. In this embodiment, four different price points 56 are printed on a first side of secondary sign 55 while a second set of four price points 57 are applied to the reverse side of secondary sign 55. Each of these separate price points are positioned on secondary sign 55 to align within window 51 when the two signs are joined. Clearly, upon the rotation of secondary sign 55 by 90 degrees, four different price points can be registered behind window 51 on each side of secondary sign 55. Further, by providing window 58 in secondary sign 55, indicia 53 intended to appear on the back side of primary sign 50 remains visible to a store clerk even when secondary sign 55 is in place. As illustrated in FIG. 2A, when signs 50 and 55 are joined, consumers are told that ground beef is offered at $3.69 per pound. To further assist counter staff by eliminating the need for them to view the front of the sign as it appears to consumers, further indicia can be placed upon the secondary sign as appropriate. In this regard, reference is made to FIGS. 2C and 2D.

FIGS. 2C and 2D illustrate the front and back sides of a singular secondary sign. On one face of secondary sign 55 are the price points $3.69, $3.79, $3.89 and $3.99 while on the opposite side of secondary sign 55 are the price points $3.29, $3.39, $3.49 and $3.59. As a means to assist counter staff, the series of recited price points appearing on the opposite face of secondary sign 55 are repeated on its borders as illustrated by features 59. These features are keyed to the pricing appearing on the opposite side of secondary sign 55. In this illustration, counter staff viewing the FIG. 2C face of secondary sign 55 would realize that the price for ground beef facing consumers is $3.29 per pound as that price appears on the top edge of FIG. 2C and highlighted as such. Similarly, when viewing the secondary sign 55 shown in FIG. 2D, counter staff would realize that consumers are viewing the price of ground beef as $3.69 per pound.

The signage of the present invention can be employed in almost any environment. It is noted that the various supports of the incorporated disclosure of applicant's parent application Ser. No. 11/936,942 provide ample examples of alternative point of sale displays. In addition, it should be noted that the secondary sign of the present invention can be placed directly behind and in contact with its accompanying primary sign as illustrated in FIG. 3. However, as alternatives, primary and secondary signs could be placed on either side of a suitable planar support. For example, applicant's parent application shows the use of channels for receiving a secondary sign behind a principle sign and the use of these various alternative physical embodiments are considered to be within the spirit and scope of the present invention. Additionally, other signage features could be joined herewith. For example, a "sell by" feature made the subject of applicant's U.S. Pat. No. 8,186,085 could be employed when dealing with perishable products requiring removal or rotation within, for example, a refrigerated case.

As noted previously, there are a number of factors which singularly or in combination require different prices to be associated with the same product or product categories. Although there may be a degree of predictability in product pricing, many products go through cycles which require variations. This results in having to inventory a plethora of secondary pricing signs which a store would access for different products and during the lifecycle of a single product. It is not unusual for a single department within a retail food establishment to inventory 50 to 100 different prices. Because various products may be sold at the same price at the same time, multiples of these price signs must be inventoried. One department could easily require a library of 500 or more individual price signs to meet its needs. In referring to FIGS. 4 and 5, to assist in organizing price signs, price point organizer 85 can be used. Secondary signs 86 can be stacked therein as shown. Although the present invention reduces price sign inventory by providing a single sign with multiple selling prices, inventorying such signs within organizer 85 can be a challenge for store personnel would have to look within the library and turn the signs front to back and rotate them in order to enable them to locate a sought-after sign within grouping 86 of signs available to the department.

In order to assist store personnel, dividers 80 and 90 are proposed and made part of the present invention. Price signs 86 are indexed and grouped behind dividers 80 or 90 which include tabs 81 and 91. Tab 81 lists the various pricing 83 for the signage contained behind the divider and thus segregated from other signs in the library. Pricing can actually be eliminated from the dividers as shown by diver 90. Dividers 80 and 90 are numbered as are the price signs noting #2 on divider 80 and on signs 1G, 2C and 2D. This enables one to segregate price signs by the number associated with the divider rather than having to match sell prices thus reducing the time necessary for clerks to select and replace the components making up the present sign system.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A sign system for displaying product information to consumers and positioned proximate a product being vended to said consumers, said sign system comprising a substantially planar support for maintaining said sign system in a desired orientation, a primary sign releasably retained by said planar support, said primary sign providing information related to said product being vended and having a window therein, and a secondary sign releasably retained behind said primary sign such that at least a portion of said secondary sign is visible through said window, said secondary sign having a plurality of alternative pricing indicia strategically positioned thereon such that through repositioning said secondary sign behind said primary sign, alternative pricing indicia is displayed through said window and wherein primary product information is provided to a first side of said primary sign for displaying said product information to consumers viewing said sign and secondary product information related to said primary product information is provided to a back side of said primary sign, said secondary sign having an opening configured therein such that when said secondary sign is positioned behind said primary sign for displaying pricing indicia through said window, said secondary product information is visible through said opening.

2. A sign system for displaying product information to consumers and positioned proximate a product being vended to said consumers, said sign system comprising a substantially planar support for maintaining said sign system in a desired orientation, a primary sign releasably retained by said planar support, said primary sign providing information related to said product being vended and having a window therein, and a secondary sign releasably retained behind said primary sign such that at least a portion of said secondary sign is visible through said window, said secondary sign having a plurality of alternative pricing indicia strategically positioned thereon such that through repositioning said secondary sign behind said primary sign, alternative pricing indicia is displayed through said window, said primary sign and said secondary sign each have a height and width wherein the height of said primary sign is greater than the height of said secondary sign, and wherein primary product information is provided to a first side of said primary sign for displaying said product information to consumers viewing said sign and secondary product information related to said primary product information is provided to a back side of said primary sign, said secondary product information being visible from a position behind said primary sign by placing said secondary product information in a region not covered by said secondary sign when said secondary sign is positioned behind said primary sign for displaying pricing indicia through said window.

3. A sign system for displaying product information to consumers and positioned proximate a product being vended to said consumers, said sign system comprising a substantially planar support for maintaining said sign system in a desired orientation, a primary sign releasably retained by said planar support, said primary sign providing information related to said product being vended and having a window therein, and a secondary sign releasably retained behind said primary sign such that at least a portion of said secondary sign is visible through said window, said secondary sign having a plurality of alternative pricing indicia strategically positioned thereon such that through repositioning said secondary sign behind said primary sign, alternative pricing indicia is displayed through said window and wherein said plurality of alternative pricing indicia is positioned on both a first side and a second side of said secondary sign such that alternative pricing is displayed through said window when both said first side and said second side are alternatively placed behind said primary sign, and wherein the alternative pricing indicia made visible through said window is visible on said secondary sign such that said pricing indicia on said first side of said secondary sign displayed through said window is identified on the second side of said secondary sign.

4. A sign system for displaying product information to consumers and positioned proximate a product being vended to said consumers, said sign system comprising a substantially planar support for maintaining said sign system in a desired orientation, a primary sign releasably retained by said planar support, said primary sign providing information related to said product being vended and having a window therein, and a secondary sign releasably retained behind said primary sign such that at least a portion of said secondary sign is visible through said window, said secondary sign having a plurality of alternative pricing indicia strategically positioned thereon such that through repositioning said secondary sign behind said primary sign, alternative pricing indicia is displayed through said window and further comprising a price point organizer for secondary signs, said secondary signs being separated by dividers, said dividers displaying the pricing of said secondary signs segregated within said price point organizer by said dividers.

5. A sign system for displaying product information to consumers and positioned proximate a product being vended to said consumers, said sign system comprising a substantially planar support for maintaining said sign system in a desired orientation, a primary sign releasably retained by said planar support, said primary sign providing information related to said product being vended and having a window therein, and a secondary sign releasably retained behind said primary sign such that at least a portion of said secondary sign is visible through said window, said secondary sign having a plurality of alternative pricing indicia strategically positioned thereon such that through repositioning said secondary sign behind said primary sign, alternative pricing indicia is displayed through said window and further comprising a price point organizer for secondary signs, said secondary signs separated by dividers, said dividers and secondary signs being marked to facilitate segregating said secondary signs with their corresponding dividers.

6. A sign system for displaying product information to consumers and positioned proximate a product being vended to said consumers, said sign system comprising a substantially planar support for maintaining said sign system in a desired orientation, a primary sign releasably retained by said planar support, said primary sign providing information related to said product being vended and having a window therein, and a secondary sign releasably retained behind said primary sign such that at least a portion of said secondary sign is visible through said window, said secondary sign having a plurality of alternative pricing indicia strategically positioned thereon such that through repositioning said secondary sign behind said primary sign, alternative pricing indicia is displayed through said window, and wherein primary product information is provided to a first side of said primary sign for displaying said product information to consumers viewing said sign and secondary product information related to said primary product information is provided to a back side of said primary sign, said secondary product information being visible from a position behind said primary sign in a region not covered by said secondary sign when said secondary sign is positioned behind said primary sign for displaying pricing indicia through said window.

* * * * *